US005320884A

United States Patent [19]

Tai et al.

[11] Patent Number: 5,320,884

[45] Date of Patent: Jun. 14, 1994

[54] SECTIONALIZED ARTIFICIAL PLANT AND FLOWER CONSTRUCTION

[75] Inventors: Patrick C. Tai, Hillsborough, Calif.; Johannes P. Juffermans, Maple, Canada

[73] Assignee: Winward International Inc., Union City, Calif.

[21] Appl. No.: 938,272

[22] Filed: Aug. 31, 1992

[51] Int. Cl.[5] ..... A41G 1/00

[52] U.S. Cl. ..... 428/24; D11/117

[58] Field of Search ..... 428/24, 25, 26; 156/61; 362/122, 123; D11/117, 118

[56] References Cited

U.S. PATENT DOCUMENTS

| | | | |
|---|---|---|---|
| 1,748,636 | 2/1930 | Crockett | 428/26 |
| 3,829,349 | 8/1974 | Hermanson | D11/118 X |
| 4,215,163 | 7/1980 | Lee | 428/26 |
| 4,585,677 | 4/1986 | Hwang et al. | 156/61 X |

*Primary Examiner*—Henry F. Epstein
*Attorney, Agent, or Firm*—Julian Caplan

[57] ABSTRACT

Different stem sections, made by injection plastic molding or other manufacturing processes are assembled to produce an artificial plant. Some of the sections resemble sections of natural plant stems from which artificial leaves or flowers extend. Other sections are spacers. Each section is formed with a bore, dimensioned to receive a common wire. The upper end of the wire receives a flower head molded or otherwise adhered thereon. One end of each section is formed with a reduced external diameter plug and the opposite end with an enlarged internal diameter bore or socket. Hence adjacent sections are threaded on the wire from the bottom up and detachably, and preferably rotatably, joined together by inserting the plug of one section into the socket of the next. The structure at the upper end of the plant varies depending on what, if any, natural plant is being imitated. In a typical embodiment, the upper end section receives the upper end of the wire and has a style and stigma. The lower end forms a reduced diameter plug. A ring slips over the lower end of the upper end section, fitting against a stop on the upper end section. From the ring extend filaments, to which are connected anthers. The lower end of the ring is formed with a reduced diameter plug. An extended length bottommost section may be injection molded onto the wire after assembly of the other sections.

10 Claims, 1 Drawing Sheet

SECTIONALIZED ARTIFICIAL PLANT AND FLOWER CONSTRUCTION

BACKGROUND OF THE INVENTION

1. Field of the Invention

This invention relates to a new and improved sectionalized artificial plant having a central wire, a stamen molded onto the top end of the wire, and a plurality of preferably injection-molded plastic stem sections which are slipped over the wire from the bottom and are formed to interfit so as to simulate a natural plant stem. Branches extend from at least some of the stem sections and are integrally formed with leaves or other foliage. The lower end of the wire is closed off with a bottom stem section of extended length so that the wire may be cut to length when arranging the plant or flower for display.

2. Description of the Related Art

One type of artificial plants and flowers, as presently commercially available, are formed with plastic, injection-molded stems. Unitized leaves and flowers are attached to such stems by co-operating snap-on means molded onto the stem and into the leaves and flowers. Unfortunately, such snap-on means are ineffective and pieces of the plant frequently fall off.

Injection molding of leaves, including the filaments to which they are attached, and flowers is commonly practiced. Such leaves, flowers and filaments are then "double injected" onto the main stem. In order to close the mold, about one inch on either side of the stem must be without leaves. Wires must be implanted in the leaf stems. Once molded, the branches may not be twisted relative to each other. The present invention eliminates the double injection operation.

Flower heads are frequently assembled on the upper end of the stem and are secured either by a snap-on arrangement or by adhesive.

The present invention eliminates many of the problems of prior constructions as hereinafter appears.

SUMMARY OF INVENTION

The stem of the present invention is formed around a wire. A flower head or stamen is attached to the upper end of the wire preferably by being injection molded thereto. The design of the flower head is subject to wide variation. In one form of the invention the flower head comprises a stigma having a style depending therefrom formed at its lower end with a cylindrical exterior. A ring is dimensioned to slip up from the bottom of the wire over the lower end of the cylindrical section and is held in place by a stop formed on the exterior of the cylindrical section. Filaments extend outwardly and upwardly from the periphery of the ring and anthers may be secured to the filaments by various means.

Below the flower head is a plurality of tubular stem sections which slide up from the bottom over the wire and have an exterior simulating a plant stem. Some of the stem sections have integral branches extending outward therefrom carrying integral leaves or flowers on their outer ends. The leaves, branches and stem sections are molded in a single injection-molding process prior to assembly on the wire. A feature of their construction is that they need not (although they can be) molded around wires.

Other stem sections are spacers——carrying no branches or leaves——interposed between sections having branches.

Each stem section except the topmost and bottomost, is formed with means to interconnect with the adjacent sections. Thus in a preferred form of the invention illustrated herein, the upper end of each stem section except the topmost and bottomost, is formed with a reduced external diameter providing a plug while the adjacent end of the next stem section is formed with an increased internal diameter bore or socket to receive the plug. Accordingly, each stem section in order is slipped over the lower end of the wire; and the adjacent sections are connected by their plugs fitting into sockets of adjacent sections. Although the stem sections fit fairly tightly over the wire, there is sufficient difference in diameter so that the sections readily slip over the wire; and after they are in place, one section may be turned relatively to the other, a feature which is not possible in molded stem sections. The various sections are rotatable relative to each other.

Preferably the end of the wire below the last section is closed off by a bottom section molded thereon which has an upward extending plug which fills the socket of the next lowermost stem section. The end is of sufficient length so that it may be cut by the flower arranger to an appropriate length.

It will be understood that moldable stems may be joined together to form what resembles a small bush.

An advantage of the invention is that less intricate molding equipment is required and the level of labor skill is reduced over prior injection molded plants and flowers. Further, there is no possibility of leaves or flowers dropping off the stem.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 2:
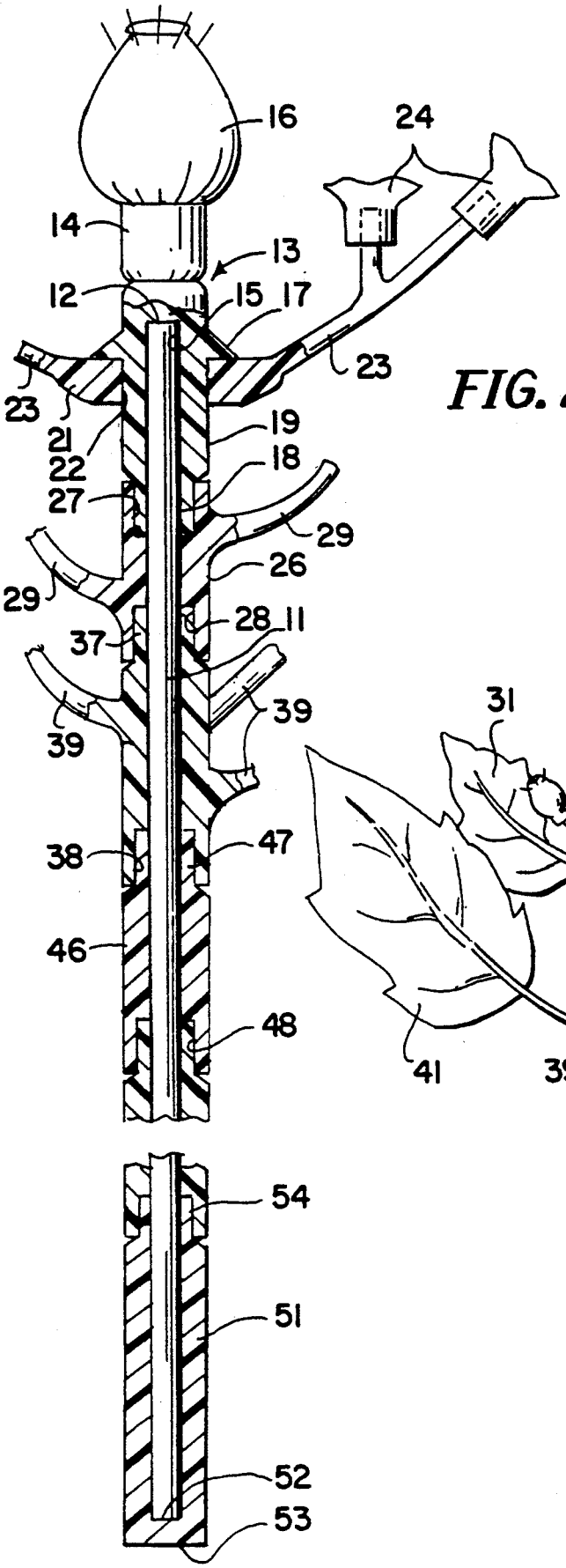
FIG. 2 is an enlarged sectional view of a portion of FIG. 1.
Figure 1:
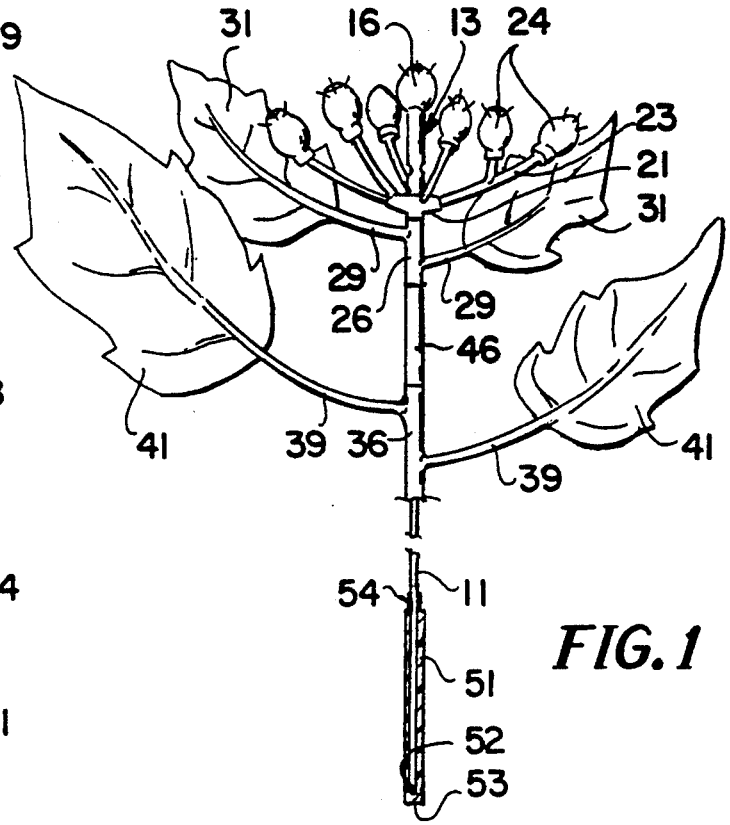
FIG. 1 is a schematic elevational view of an artificial plant formed in accordance with the present invention partly broken away to reveal internal construction.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The artificial plant of the present invention is assembled around a semi-rigid wire 11. On the upper end 12 of wire 11 is formed a flower head or upper stem section 13 preferably attached by injection molding but optionally by adhesive. It will be understood that the shapes of the various elements of the flower head 13 are subject to wide variation. One suitable flower head is illustrated and described herein. In the particular shape shown, there is a section 13 having a cylindrical exterior 19 and internal bore 15 above which is a style 14 surmounted by stigma 16. Stop 17 extends outward from the cylindrical exterior 19.

As an optional further feature of the flower head 13 a ring 21, having a hole 22 dimensioned to slip over the bottom of wire 11 and then over the cylindrical exterior 19 to abut stop 17, is provided. Extending outwardly from ring 21 is a plurality of filaments 23, and for each filament an anther 24 is provided, the anthers being preferably attached thereto in a snap socket arrangement. The lower end of cylindrical section 19 is formed with a reduced diameter to provide a plug 18.

Below the flower head 13 is a plurality of integrally molded tubular stem sections each having an exterior simulating a natural stem and each slipped up over wire 11 from the bottom. Stem section 26 is provided with enlarged internal diameter portions at top and bottom to form top and bottom sockets 27 and 28. Socket 27 receives plug 18. Integrally molded with section 26 are branches 29 extending outwardly having leaves 31 at their outer ends. It will be understood that the pattern of leaves is subject to a wide variation depending upon the type plant or flower being simulated.

Below section 26 is a third stem section 36, the upper end of which is formed with a reduced external diameter to form a plug 37, and the lower end of which is formed with an enlarged internal diameter to form a socket 38. Section 36 likewise has stems 39 extending outwardly and carrying leaves 41. Preferably the tubular portion 36, stems 39 and leaves 41 are integrally molded but other fabrication may be used. Preferably the stems do not require wires.

Spacer stem sections 46 are provided to space the leaf bearing sections apart. Spacers 46 are formed with plugs 47 and sockets 48 to mate with the plugs and sockets of adjacent sections 36.

It will be noted that the various sections 26, 36 and 46 may be twisted relative to each other to provide the particular plant or flower design desired.

Preferably the bottom stem section 51 is molded onto the lower end 52 of wire 11 after the other stem sections have been assembled thereon. Section 51 has a bottom 53 which conceals lower end 52. During the molding process, plug 54 is formed on the upper end of bottom stem section 51 and fits into the socket 38 or 48 of the super-imposed stem section. Lower end 52 is sufficiently long so that the arranger may cut to suitable length.

A plurality of step sections may be secured together as by injection molding to form a larger bush. It will be understood that the number of sections and their arrangement is a matter of design and that the flower head 13 may be varied widely depending upon the choice of design.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. An artificial plant comprising, a wire, at least one first section, said first section having a tubular portion threaded over said wire having an exterior simulating a portion of a natural stem, at least one branch integral with said tubular portion extending outwardly therefrom and at least one leaf integral with said branch, first and second connecting means at a first and second end of said tubular portion, respectively, said connecting means being shaped to interengage with abutting similar sections threaded over said wire, at least one tubular second section threaded over said wire and having first and second connecting means at a first and second end of said section, respectively, said first and second sections being initially discrete and individually movable along said wire.

2. A plant according to claim 1 in which said first connecting means is integral with said sections and comprises a reduced diameter exterior forming a plug and said second connecting means is integral with said sections and comprises an enlarged diameter interior forming a socket shaped to receive a plug.

3. A plant according to claim 2 in which said first section, said branch and said leaf are formed integral by plastic injection molding.

4. A plant according to claim 2 in which said first section is rotatable relative to said wire.

5. A plant according to claim which further comprises a flower head fixed to the upper end of said wire, said flower head simulating a natural flower.

6. A plant according to claim 5 in which at least a portion of said flower head is injection-molded onto said upper end of said wire.

7. A plant according to claim 5 in which said flower head has an external substantially cylindrical portion at its lower end and which further comprises a ring adapted to slip up over said cylindrical portion, a plurality of filaments extending outward spaced around the circumference of said ring, and at least one another-simulating member on each said filament.

8. A plant according to claim 7 which further comprises a stop on said cylindrical portion to limit upward movement of said ring.

9. A plant according to claim 1 which further comprises a bottom stem section on the lower end of said wire and formed with one of said connecting means fitting into an opposite connecting means on an abutting opposite connecting means on the stem section above said bottom stem section.

10. A plant according to claim 9 in which said bottom stem section is injection-molded on said lower end of said wire.

* * * * *